US010930997B2

(12) United States Patent
Tong et al.

(10) Patent No.: US 10,930,997 B2
(45) Date of Patent: Feb. 23, 2021

(54) CONNECTION STRUCTURE

(71) Applicant: SZ DJI TECHNOLOGY CO., LTD., Shenzhen (CN)

(72) Inventors: Zhao Tong, Shenzhen (CN); Jiangang Feng, Shenzhen (CN)

(73) Assignee: SZ DJI TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 16/664,544

(22) Filed: Oct. 25, 2019

(65) Prior Publication Data

US 2020/0058982 A1 Feb. 20, 2020

Related U.S. Application Data

(63) Continuation of application No. PCT/CN2017/089255, filed on Jun. 20, 2017.

(30) Foreign Application Priority Data

Apr. 28, 2017 (CN) ..... 201720470700.6

(51) Int. Cl.
*H01Q 1/24* (2006.01)

(52) U.S. Cl.
CPC ..... *H01Q 1/24* (2013.01)

(58) Field of Classification Search
CPC ..... H01Q 1/24
USPC ..... 343/878
See application file for complete search history.

(56) References Cited

U.S. PATENT DOCUMENTS 6,152,753 A * 11/2000 Johnson ..... H01R 13/622 439/312
6,467,447 B1 * 10/2002 Holmes ..... F02P 13/00 123/169 PA

FOREIGN PATENT DOCUMENTS

| | | | |
|---|---|---|---|
| CN | 1318212 | A | 10/2001 |
| CN | 1451188 | A | 10/2003 |
| CN | 1825696 | A | 8/2006 |
| CN | 101023556 | A | 8/2007 |
| CN | 2012189979 | U | 4/2012 |
| CN | 203398334 | U | 1/2014 |
| CN | 203690653 | U | 7/2014 |
| CN | 203763415 | U | 8/2014 |

(Continued)

OTHER PUBLICATIONS

The World Intellectual Property Organization (WIPO) International Search Report for PCT/CN2017/089255 dated Jan. 18, 2018 9 pages.

(Continued)

*Primary Examiner* — Andrea Lindgren Baltzell
(74) *Attorney, Agent, or Firm* — Anova Law Group, PLLC

(57) ABSTRACT

A connection structure includes an elastic member and a knob. The elastic member includes a bottom portion and an elastic piece extending from the bottom portion and including a free end not contacting the bottom portion. The free end includes a first protrusion extending outward along a radial direction of the elastic member and a second protrusion extending inward along the radial direction of the elastic member. The knob is configured to engage with the elastic member and includes a fitting slot formed at an inner wall of the knob. The fitting slot includes a first portion and a second portion in a circumferential direction of the knob (Continued)

for engaging with the first protrusion of the elastic piece. A depth of the first portion is smaller than a depth of the second portion.

18 Claims, 8 Drawing Sheets

(56) References Cited

FOREIGN PATENT DOCUMENTS

| | | | |
|---|---|---|---|
| CN | 204045848 | U | 12/2014 |
| CN | 206685525 | U | 11/2017 |
| JP | 2000252727 | A | 9/2000 |
| JP | 2000307318 | A | 11/2000 |

OTHER PUBLICATIONS

Deqing Chen, et al., Design of High Shielding Efficiency Coaxial Cable Assembly, Electronic Technology & Softwart, Engineering, Jan. 13, 2016, China.
Yonggang Liu, et al., Design Summary of Common Used Contacts of Electrical Connectors, Electromechanical Components, vol. 36 No. 1, Feb. 25, 2016, China.

* cited by examiner

CONNECTION STRUCTURE

CROSS-REFERENCE TO RELATED APPLICATION

This application is a continuation application of International Application No. PCT/CN2017/089255, filed on Jun. 20, 2017, which claims priority to Chinese Application No. 201720470700.6, filed on Apr. 28, 2017, the entire contents of both of which are incorporated herein by reference.

TECHNICAL FIELD

The present disclosure relates to the technical field of connection mechanism and, more particularly, to a connection structure.

BACKGROUND

Antennas of a remote controller of an unmanned aerial vehicle (UAV) are generally inserted into a housing of the remote controller and are rotatably connected to the housing, thereby facilitating a folding and unfolding of the antennas. However, assembly and disassembly of the antenna are very inconvenient and, in some scenario, cannot satisfy the requirements. For example, the antennas need to be disassembled to avoid difficulty in packaging or damage during transportation.

SUMMARY

In accordance with the disclosure, there is provided a connection structure including an elastic member and a knob. The elastic member includes a bottom portion and an elastic piece extending from the bottom portion and including a free end not contacting the bottom portion. The free end includes a first protrusion extending outward along a radial direction of the elastic member and a second protrusion extending inward along the radial direction of the elastic member. The knob is configured to engage with the elastic member and includes a fitting slot formed at an inner wall of the knob. The fitting slot includes a first portion and a second portion in a circumferential direction of the knob for engaging with the first protrusion of the elastic piece. A depth of the first portion is smaller than a depth of the second portion.

Also in accordance with the disclosure, there is provided an apparatus including a first component, a second component, and a connection structure configured to mount the first component to the second component. The first component includes a plug portion having a cylindrical shape and including a first fitting slot formed at an outer axial surface of the plug portion. The second component includes a housing and a bushing extending outward from the housing. The plug portion is inserted in the bushing when the first component is mounted to the second component. The connection structure includes an elastic member and a knob. The elastic member is configured to extend from an inside of the housing to an outside of the bushing and includes a bottom portion configured to be locked at the housing and an elastic piece extending from the bottom portion to the bushing. The elastic piece includes a free end not contacting the bottom portion. The free end includes a first protrusion extending outward along a radial direction of the elastic member and a second protrusion extending inward along the radial direction of the elastic member. The knob is configured to be rotatably sleeved on the bushing and includes a second fitting slot formed at an inner wall of the knob. The second fitting slot includes a first portion and a second portion in a circumferential direction of the knob for engaging with the first protrusion of the elastic piece. A depth of the first portion is smaller than a depth of the second portion. The second fitting slot is configured such that when the first protrusion engages with the first portion, the second protrusion is fitted in the first fitting slot to fixedly attach the first component to the second component, and when the first protrusion engages with the second portion, the second protrusion disengages from the first fitting slot to allow the first component to be detached from the second component.

DESCRIPTION OF REFERENCE NUMERALS

Figure 1:
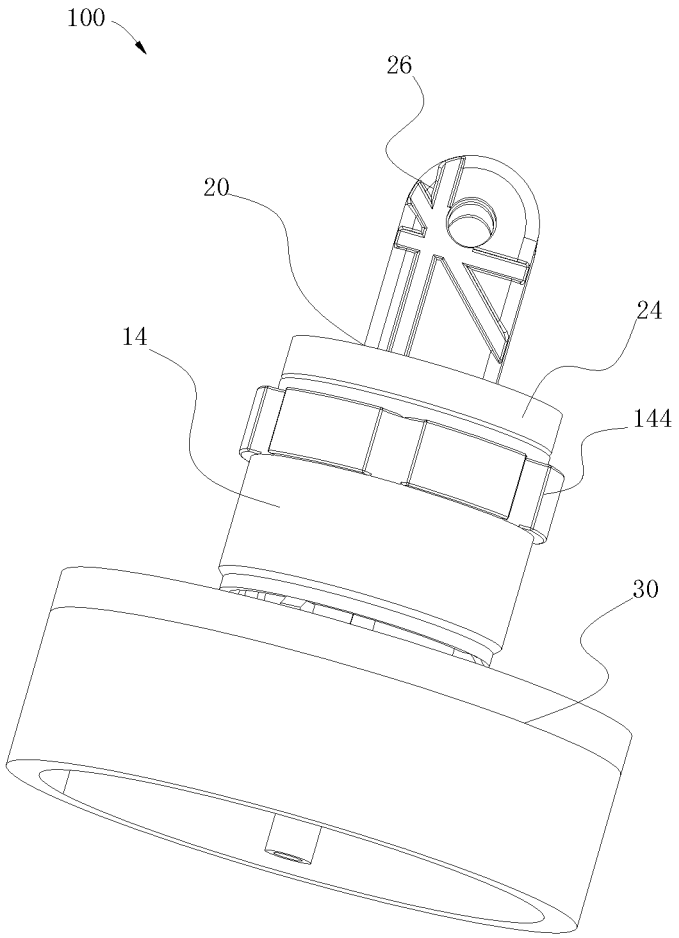
FIG. 1 schematically shows a partial perspective view of a remote-control apparatus having a connection structure consistent with the disclosure.

UAV system 1000
Remote-control apparatus 100
Connection structure 10
Elastic member 12
Bottom portion 122
Chassis 1222
Through hole 1222*a*
Notch 1222*b*
Connection portion 1224
Abutting portion 1226
Reinforcing member 1228
Elastic piece 124
Free end 1242
First protrusion 1242*a*
Second protrusion 1242*b*
Knob 14
Second fitting slot 142
Operation portion 144
First portion 1422
Second fitting sub-slot 1422*a*
Second portion 1424
First component 20
Plug portion 22
First fitting slot 222
Mounting groove 224
Flange 24
Antenna portion 26
Male connector 28
Second component 30

Housing 32
Bottom surface 322
Connecting hole 324
Bushing 34
Female connector 36
First cylinder 362
Second cylinder 364
UAV 200

DETAILED DESCRIPTION OF THE EMBODIMENTS

Example embodiments will be described with reference to the accompanying drawings, in which the same numbers refer to the same or similar elements unless otherwise specified. It will be appreciated that the described embodiments are merely example and illustrative, and not intended to limit the scope of the disclosure.

The terms "center", "longitudinal," "transverse," "length," "width," "thickness," "above," "below," "front," "back," "left," "right," "vertical," "horizontal," "top," "bottom," "inside," "outside," "clockwise," and "counterclockwise," used herein are defined by orientation or positional relationships shown in the example drawings and are merely for illustrative instead of indicating or implying that an apparatus or component has a particular orientation or needs to be arranged or operated according to the particular orientation. It is not intended to limit the scope of the disclosure.

The terms "first," "second," or the like in the specification, claims, and the drawings of the disclosure are merely illustrative, e.g., distinguishing similar elements, defining technical features, or the like, and are not intended to indicate or imply the importance of the corresponding elements or the number of the technical features. Thus, features defined as "first" and "second" may explicitly or implicitly include one or more of the features. As used herein, "a plurality of" means two or more, unless there are other clear and specific limitations.

As used herein, the terms "mounted," "coupled," and "connected" should be interpreted broadly, unless there are other clear and specific limitations. For example, the connection between two assemblies may be a fixed connection, a detachable connection, or an integral connection. The connection may also be a mechanical connection, an electrical connection, or a mutual communication connection. Furthermore, the connection may be a direct connection or an indirect connection via an intermedium, an internal connection between the two assemblies or an interaction between the two assemblies.

As used herein, unless otherwise defined, when a first component is referred to as "above" or "below" the second component, it is intended that the first component may be directly attached to the second component or may be indirectly attached to the second component via another component. When the first component is referred to as "above," "over," and "beyond" the second component, it is intended that the first component is directly or obliquely above the second component or a position of the first component is higher than a position of the second component. When the first component is referred to as "below," "under," and "beneath" the second component, it is intended that the first component is directly or obliquely below the second component or the position of the first component is lower than the position of the second component.

Various example embodiments corresponding to different structures of the disclosure will be described. For simplification purposes, the elements and configurations for the example embodiments are described below. It will be appreciated that the described embodiments are example only and not intended to limit the scope of the disclosure. Moreover, the references of numbers or letters in various example embodiments are merely for the purposes of clear and simplification, and do not indicate the relationship between the various example embodiments and/or configurations. In addition, the use of other processes and/or materials will be apparent to those skilled in the art from consideration of the examples of various specific processes and materials disclosed herein.

Figure 2:
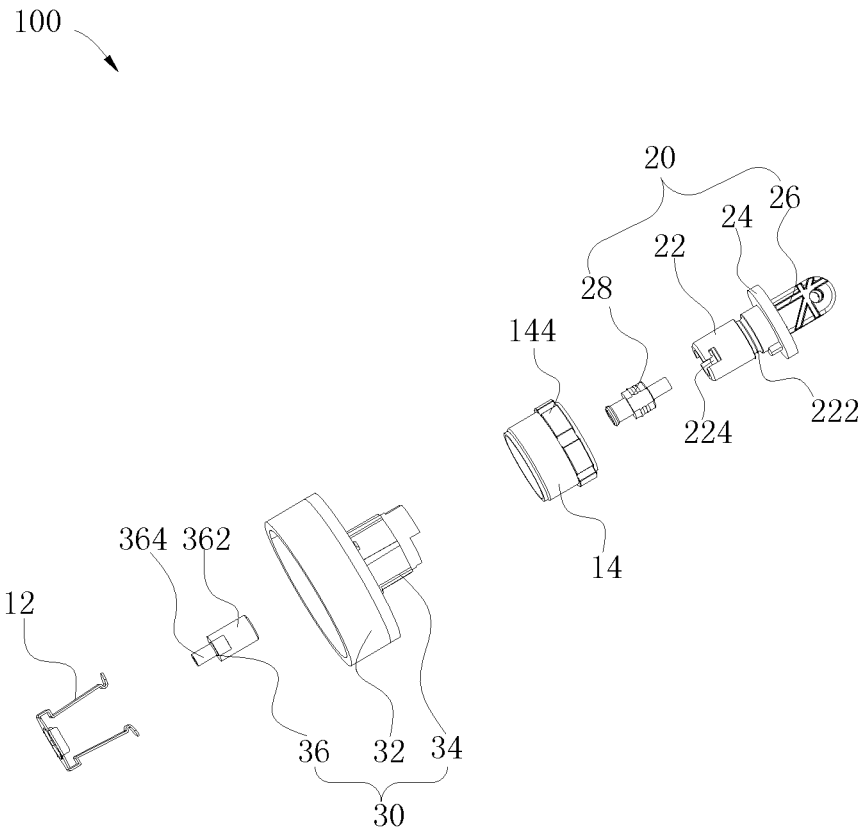
FIG. 2 schematically shows a partial exploded view of a remote-control apparatus consistent with the disclosure.
Figure 3:
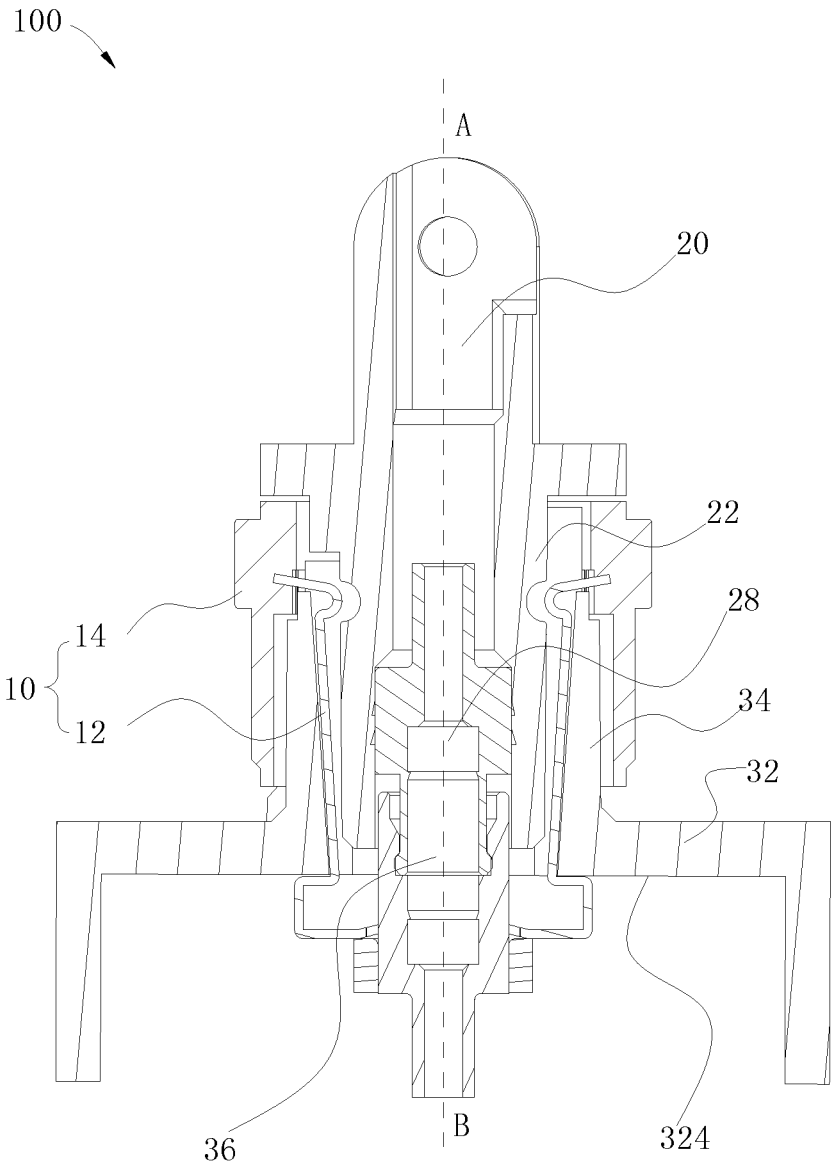
FIG. 3 schematically shows a partial cross-sectional view of a remote-control apparatus consistent with the disclosure.

FIG. 1 schematically shows a partial perspective view of an example remote-control apparatus 100 having a connection structure 10 consistent with the disclosure. FIG. 2 schematically shows a partial exploded view of the remote-control apparatus 100 consistent with the disclosure. FIG. 3 schematically shows a partial cross-sectional view of the remote-control apparatus 100 consistent with the disclosure. As shown in FIGS. 1 to 3, the connection structure 10 is configured to mount a first component 20 to a second component 30.

As shown in FIGS. 2 and 3, the first component 20 includes a plug portion 22 having a cylindrical shape. A first fitting slot 222 is formed at an outer axial surface of the plug portion 22. The second component 30 includes a housing 32 and a bushing 34 extending outward from the housing 32. The plug portion 22 can be inserted into the bushing 34. As shown in FIG. 3, the connection structure 10 includes an elastic member 12 and a knob 14. The elastic member 12 extends from an inside of the housing 32 to an outside of the bushing 34.

Figure 4:
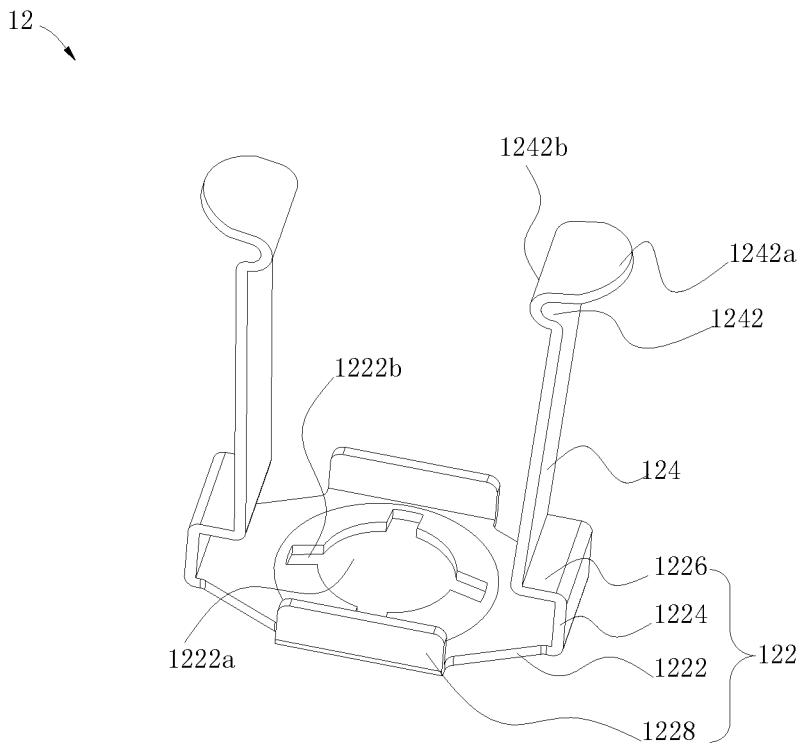
FIG. 4 schematically shows a perspective view of an elastic member of a connection structure consistent with the disclosure.

FIG. 4 schematically shows a perspective view of the elastic member 12 of the connection structure 10 consistent with the disclosure. As shown in FIG. 4, the elastic member 12 includes a bottom portion 122 configured to be locked at the housing 32 and at least two elastic pieces 124 extending from the bottom portion 122 to the bushing 34. Each elastic piece 12 includes a free end 1242 extending out of the bushing 34. Each free end 1242 includes a first protrusion 1242*a* extending outward along a radial direction of the elastic member 12 and a second protrusion 1242*b* extending inward along the radial direction of the elastic member 12.

Figure 5:
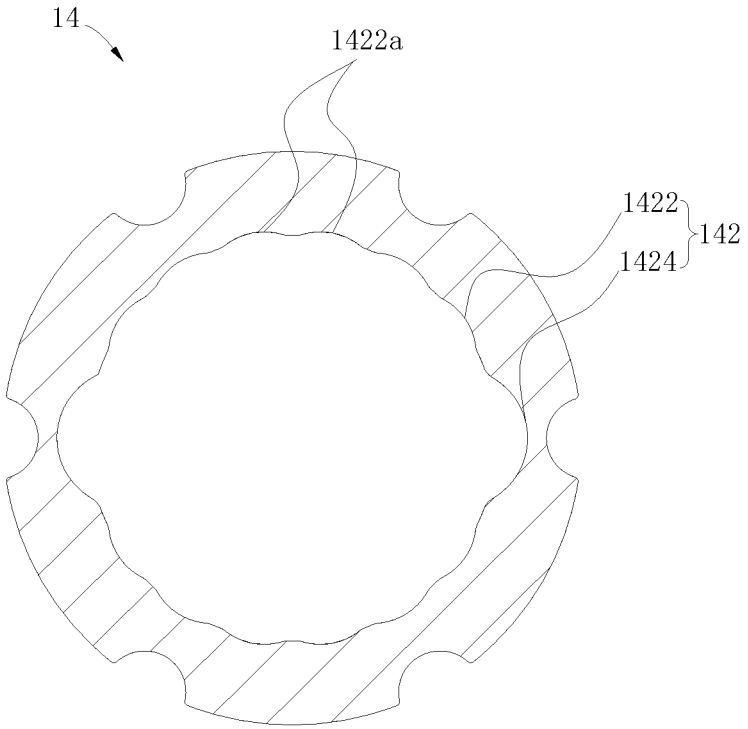
FIG. 5 schematically shows a cross-sectional view of a knob of a connection structure consistent with the disclosure.

FIG. 5 schematically shows a cross-sectional view of the knob 14 of the connection structure 10 consistent with the disclosure. As shown in FIGS. 2 and 4, the knob 14 is rotatably sleeved on the bushing 34. As shown in FIG. 5, a second fitting slot 142 is formed at an inner wall of the knob 14 and cooperates with the first protrusions 1242*a*. The second fitting slot 142 includes a first portion 1422 and a second portion 1424 in a circumferential direction of the knob 14, and a depth of the first portion 1422 is smaller than a depth of the second portion 1424. As shown in FIGS. 1 to 3, when the knob 14 is rotated to cause each elastic piece 124 to be pressed inward along a radial direction of the elastic member 12 and fitted into the first portion 1422, each second protrusion 1242*b* can be fitted into the first fitting slot 222 to fixedly attach the first component 20 to the second component 30. When the knob 14 is rotated to cause each elastic piece 124 to be pressed inward along the radial direction of the elastic member 12 and fitted into the second portion 1424, each second protrusion 1242*b* can be disengaged from the first fitting slot 222 to allow the first component 20 to be detached from the second component 30.

For example, the elastic member 12 can extend from the inside of the housing 32 to an outside of the bushing 34 and cause each first protrusion 1242*a* to be fitted into the second fitting slot 142. When each first protrusion 1242*a* is fitted into the first portion 1422, the elastic member 12 can be elastically deformed by an inward pressure along a radial direction of the elastic member 12 and can be pressed inward along the radial direction of the elastic member 12. When the knob 14 is rotated to cause each first protrusion 1242*a* to rotate from the first portion 1422 to the second portion 1424 having a deeper depth, each elastic piece 124 can be ejected outward along the radial direction of the elastic member 12, such that each second protrusion 1242*b* can be disengaged from the first fitting slot 222.

According to the connection structure 10 consistent with the disclosure, the first component 20 can be detachably and rotatably mounted to the second component 30 by the cooperation of the elastic member 12 and the knob 14. The assembly and disassembly can be simple and convenient.

In some embodiments, as shown in FIG. 3, when the first component 20 is mounted at the second component 30 by the connection structure 10, a central axis A of the first component 20 coincides with a central axis B of the elastic member 12, and the first component 20 can rotate relative to the housing 32 and the bushing 34 about the central axis B of the elastic member 12.

In some embodiments, the connection structure 10 is applicable to the remote-control apparatus 100. The remote-control apparatus 100 can include a remote-control body and an antenna assembly. The first component 20 can include the antenna assembly and the second component 30 can include the remote-control body. The remote-control body can include the housing 32 and the bushing 34 extending outward from the housing 32. Therefore, the connection structure 10 can be used by the remote-control apparatus 100 for detachably and rotatably mounting the antenna assembly on the remote-control body.

As such, the antenna assembly can be easy to disassemble, and can be particularly benefit for disassembly of the antenna assembly in some applications. For example, the antenna assembly can be disassembled to avoid difficulty in packaging or damage during transportation.

When the antenna assembly is mounted at the remote-control body via the connection structure 10, the central axis A of the antenna assembly can coincide with the central axis B of the remote-control body, and the antenna assembly can rotate relative to the housing 32 and the bushing 34 about the central axis B of the remote-control body.

In some embodiments, the remote-control apparatus 100 can be applied to an unmanned aerial vehicle (UAV) system 1000 and used to control a UAV 200. For example, the antenna assembly of the remote-control apparatus 100 can be mounted at the remote-control body and unfolded, and the remote-control apparatus 100 can transmit signals to the UAV 200 via the antenna assembly.

As shown in FIGS. 1 to 3, the connection structure 10 can be configured to mount the first component 20 to the second component 30. As shown in FIG. 3, the connection structure 10 includes the elastic member 12 and the knob 14.

As shown in FIGS. 2 and 3, the first component 20 includes the plug portion 22 having a cylindrical shape. The first fitting slot 222 is formed at the outside axis surface of the plug portion 22. For example, the first fitting slot 222 can have an annular shape. The second component 30 includes the housing 32 and the bushing 34 extending outward from the housing 32. An inner surface of the bushing 34 has an inverted truncated cone shape. The plug portion 22 can be inserted into the bushing 34.

The elastic member 12 can extend from the inside of the housing 32 to out of the bushing 34. As shown in FIG. 4, the elastic member 12 includes the bottom portion 122 locked at the housing 32 and the at least two elastic pieces 124 extending from the bottom portion 122 to the bushing 34. For example, the at least two elastic pieces 124 can be evenly distributed in an annular array. The at least two elastic pieces 124 can abut against the inner surface of the bushing 34 after extending out of the bushing 34. In some embodiments, the bottom portion 122 of the elastic member 12 and the at least two elastic pieces 124 can be integrally formed. In some other embodiments, the bottom portion 122 of the elastic member 12 and the at least two elastic pieces 124 may be not integrally formed. For example, the at least two elastic pieces 124 and the bottom portion 122 can be connected through welding. The elastic member 12 may be made of a metal material or a non-metal material. In some embodiments, the number of the elastic pieces 124 can be two and the two elastic pieces 124 can be symmetrically arranged. In some other embodiments, the number of the elastic pieces 124 can be three, four, or any number.

As shown in FIG. 4, the bottom portion 122 includes a chassis 1222, at least two connection portions 1224 extending upward from an edge of the chassis 1222, and at least two abutting portions 1226. Each abutting portion 1226 extends inward along a radial direction of the elastic member 12 from an end of the corresponding connection portion 1224 distal from the chassis 1222. Each elastic piece 124 extends upward and outward along a radial direction of the elastic member 12 from an end of the corresponding abutting portion 1226 distal from the corresponding connection portion 1224. The at least two abutting portions 1226 can abut against the bottom surface 322 of the housing 32 to attach the elastic member 12 to the second component 30. In some embodiments, the chassis 1222 includes a through hole 1222*a*, such that the second component 30 can extend out of the through hole 1222*a*. In some other embodiments, the at least two connection portions 1224 and the at least two abutting portions 1226 can be omitted. For example, the bottom portion 122 can merely include the chassis 1222. The chassis 1222 can abut against the bottom surface 322 of the housing 32, and the at least two elastic pieces 124 can extend from the chassis 1222 toward the bushing 34.

Each elastic piece 12 includes the free end 1242 extending out of the bushing 34. Each free end 1242 includes the first protrusion 1242*a* extending outward along the radial direction of the elastic member 12 and the second protrusion 1242*b* extending inward along the radial direction of the elastic member 12. The first fitting slot 222 can include an annular groove that cooperates with the second protrusions 1242*b*.

Figure 6:
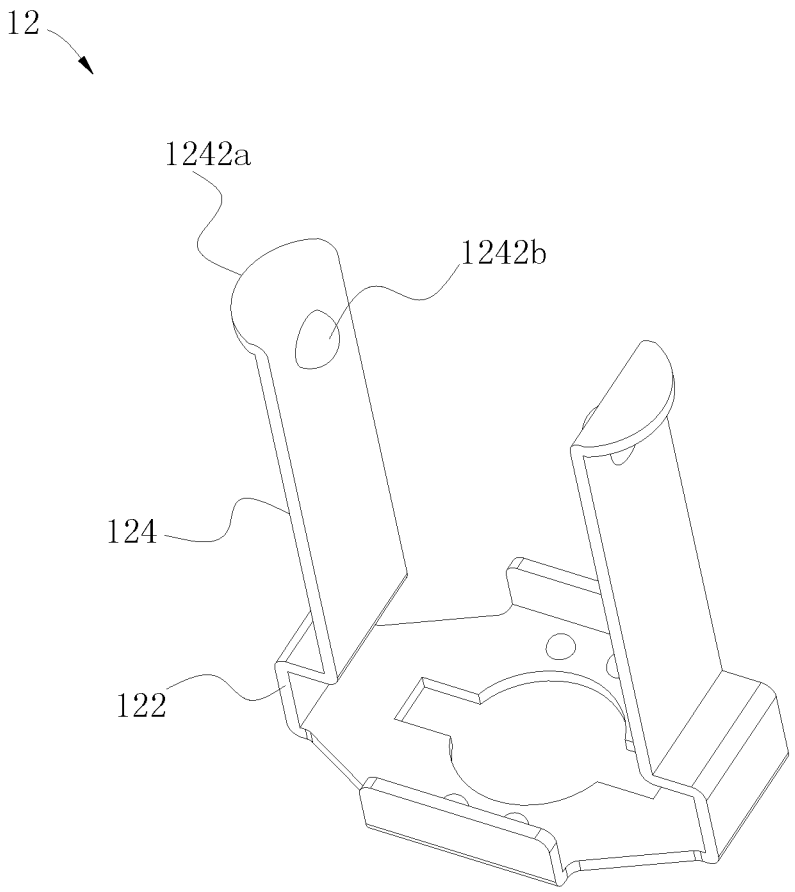
FIG. 6 schematically shows a perspective view of an elastic member of another connection structure consistent with the disclosure.

FIG. 6 schematically shows a perspective view of the elastic member 12 of the connection structure 10 consistent with the disclosure. As shown in FIGS. 4 and 6, each first protrusion 1242*a* may be formed by bending the corresponding free end 1242 outward along the radial direction of the elastic member 12, or may include a protruding portion that is inward convex from the corresponding free end 1242 along the radial direction of the elastic member 12. The end of each first protrusion 1242*a* can form a curved edge. Each second protrusion 1242*b* may be formed by bending the corresponding free end 1242 outward along the radial direction of the elastic member 12, or may include a protruding portion that is inward convex from the corresponding free end 1242 along the radial direction of the elastic member 12. In some other embodiments, each first protrusion 1242*a* and each second protrusion 1242*b* can have other structures different from the structures described herein.

As shown in FIGS. 2 and 4, the knob 14 is rotatably sleeved on the bushing 34. As shown in FIG. 5, the second fitting slot 142 is formed at the inner wall of the knob 14 and cooperates with the first protrusions 1242*a*. The second fitting slot 142 includes the first portion 1422 and the second portion 1424 in the circumferential direction, and the depth of the first portion 1422 is smaller than the depth of the second portion 1424. In some embodiments, the first portion 1422 can include a plurality of second fitting sub-slots 1422*a* that can cooperate with the first protrusions 1242*a*. For example, a size and shape of the first portion 1422 can be cooperated with the curved edge of each first protrusion 1242*a*. In some embodiments, the first portion 1422 can have an annular shape and arranged around the inner wall of the knob 14. The second portion 1424 can divide the first portion 1422 into the plurality of second fitting sub-slots 1422*a* having a circular arc shape. For example, when the number of the elastic pieces 124 is two, the second portion 1424 can divide the first portion 1422 into two second fitting sub-slots 1422*a* having the circular arc shape. When the number of the elastic pieces 124 is three, the second portion 1424 can divide the first portion 1422 into three second fitting sub-slots 1422*a* having the circular arc shape.

When the knob 14 is rotated to cause the at least two elastic pieces 124 to be pressed inward along the radial direction of the elastic member 12 and fitted into the first portion 1422, each second protrusion 1242*b* can be fitted into the first fitting slot 222 to fixedly attach the first component 20 to the second component 30. When the knob 14 is rotated to cause the at least two elastic piece 124 to be pressed inward along the radial direction of the elastic member 12 and fitted into the second portion 1424, each second protrusion 1242*b* can be disengaged from the first fitting slot 222 to allow the first component 20 to be detached from the second component 30.

As shown in FIGS. 1 and 2, the knob includes an operation portion 144. An outer edge of a cross section of the operation portion 144 perpendicular to a central axis of the operation portion 144 can have a polygonal shape or a circle shape having a plurality of concave or convex sub-arcs. In some other embodiments, the operation portion 144 can have other structures. For example, a plurality of bumps may be provided on the operation portion 144, or a plurality of stripes may be formed on an outer surface of the operation portion 144.

According to the connection structure 10 consistent with the disclosure, the first component 20 can be detachably and rotatably mounted to the second component 30 by the cooperation of the elastic member 12 and the knob 14. The assembly and disassembly can be simple and convenient.

Consistent with the disclosure, the first fitting slot 222 can include the annular groove that cooperates with the second protrusions 1242*b*. When the first component 20 is mounted at the second component 30 via the connection structure 10, the central axis A of the first component 20 can coincide with the central axis B of the elastic member 12, such that the first component 20 can rotate about the central axis B of the elastic member 12.

Consistent with the disclosure, the at least two elastic pieces 124 can be evenly distributed in the annular array, such that the first component 20 can be rotated. Therefore, when the first protrusions 1242*a* are fitted into the second fitting slot 142, a force can be evenly applied on the knob 14, and when the second protrusions 1242*b* are fitted into the first fitting slot 222, a force can be evenly applied on the first component 20.

Consistent with the disclosure, the bottom portion 122 can include the at least two abutting portions 1226. The at least two abutting portions 1226 can abut against the bottom surface 322 of the housing 32, and each elastic piece 124 can extend upward and outward along the radial direction of the elastic member 12 from the end of the corresponding abutting portion 1226 distal from the corresponding connection portion 1224. As such, the second component 30 can be more firmly connected to the elastic member 12.

Consistent with the disclosure, the end of each first protrusion 1242*a* can form the curved edge. When the knob 14 is rotated, a friction when the first protrusions 1242*a* slide into or out of the second fitting slot 142 can be small, thereby allowing the rotation of the knob 14 to be less labor intensive. The small friction can reduce the wear of the first protrusion 1242*a*, and thus can prolong a service life of the product.

Consistent with the disclosure, the outer edge of the cross section of the operation portion 144 perpendicular to the central axis of the operation portion 144 can have the polygonal shape or the circle shape having the plurality of concave or convex sub-arcs. As such, when the user rotates the knob 14, the friction between the knob 14 and fingers of the user can be large, which is convenient for the user to rotate the knob 14. The disassembly can be easier.

As shown in FIGS. 1 to 3, an example remote-control apparatus 100 includes the first component 20, the second component 30, and the connection structure 10 consistent with the disclosure, such as any example connection structure 10 described above. The first component 20 can include the antenna assembly. The first component 20 includes the plug portion 22 having a cylindrical shape, a flange 24, an antenna portion 26, and a male connector 28. The second component 30 can include the remote-control body. The second component 30 includes the housing 32, the bushing 34 extending outward from the housing 32, and a female connector 36. The antenna assembly can be mounted to the remote-control body via the connection structure 10 described above.

Figure 7:
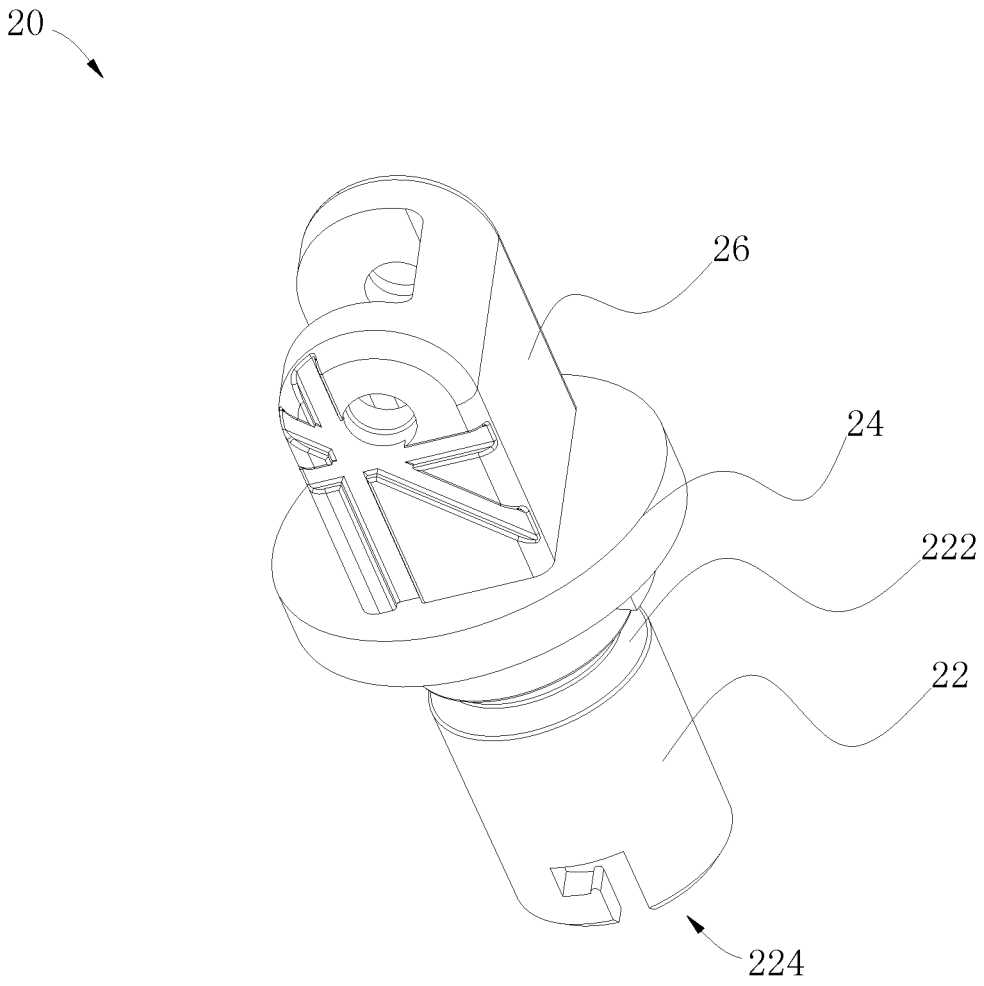
FIG. 7 schematically shows a partial structural view of a first component consistent with the disclosure.

FIG. 7 schematically shows a partial structural view of the first component 20 consistent with the disclosure. As shown in FIGS. 2 and 7, the plug portion 22 includes a mounting groove 224. The male connector 28 can be mounted in the mounting groove 224. For example, the plug portion 22 can be threaded through the bushing 34. In a radial direction of the plug portion 22, the knob 14, the bushing 34, the at least two elastic pieces 124, the plug portion 22, and the male connector 28 can be sequentially arranged in that order from the outer side to the inner side.

The flange 24 can extend outward along the radial direction of the plug portion 22 from an end of the plug portion 22 distal from the housing 32. The antenna portion 26 can extend upward from the flange 24 along an axial direction of the flange 24, and the antenna portion 26 can be configured to transmit or receive electromagnetic waves. In some embodiments, the flange 24 can abut against the knob 14. In some embodiments, a top of the knob 14 is on the same level as a top of the bushing 34, and the flange 24 can abut against the bushing 34 and the knob 14. In some other embodiments, the top of the bushing 34 can extend beyond the top of the knob 14, and the flange 24 can abut against the bushing 34. The flange 24 can allow a connection of the antenna assembly and the remote-control body to be more stable.

As shown in FIG. 4, the chassis 1222 includes the through hole 1222*a*, and a size of the through hole 1222*a* can match a size of the female connector 36. In some embodiments, the bottom portion 122 can include a reinforcing member 1228 extending upward from the chassis 1222 and configured to reinforce a strength of the chassis 1222. In some other embodiments, the reinforcing member 1228 can be omitted.

As shown in FIGS. 2 and 3, the female connector 36 is arranged in the housing 32, and the female connector 36 is connected with the male connector 28 after passing through the through hole 1222*a*. An upper portion of the female connector 36 can be a hollow cylinder, and the male connector 28 can be inserted into the female connector 36 to connect to the female connector 36. In some embodiments, as shown in FIG. 2, the female connector 36 includes a first cylinder 362 and a second cylinder 364 extending from the first cylinder 362. After passing through the through hole 1222*a*, the first cylinder 362 can be connected with the male connector 28. The second cylinder 364 can abut against the chassis 1222 and can be located between the reinforcing members 1228.

When the knob 14 is rotated to cause the at least two elastic pieces 124 to be pressed inward along the radial direction of the elastic member 12 and fitted into the first portion 1422, each second protrusion 1242*b* can be fitted into the first fitting slot 222 to fixedly attach the antenna assembly to the remote-control body. When the knob 14 is rotated to cause the at least two elastic piece 124 to be pressed inward along the radial direction of the elastic member 12 and fitted into the second portion 1424, each second protrusion 1242*b* can be disengaged from the first fitting slot 222 to allow the antenna assembly to be detached from the remote-control body.

According to the remote-control apparatus 100 consistent with the disclosure, the antenna assembly can be detachably and rotatably mounted to the remote-control body by the cooperation of the elastic member 12 and the knob 14. The assembly and disassembly can be simple and convenient and the storage and transportation of the remote-control apparatus 100 can be facilitated.

Consistent with the disclosure, when the antenna assembly is mounted at the remote-control body via the connection structure 10, the central axis A of the antenna assembly can coincide with the central axis B of the remote-control body, and the antenna assembly can rotate about the central axis B of the remote-control body to adjust an orientation of the antenna assembly.

Figure 8:
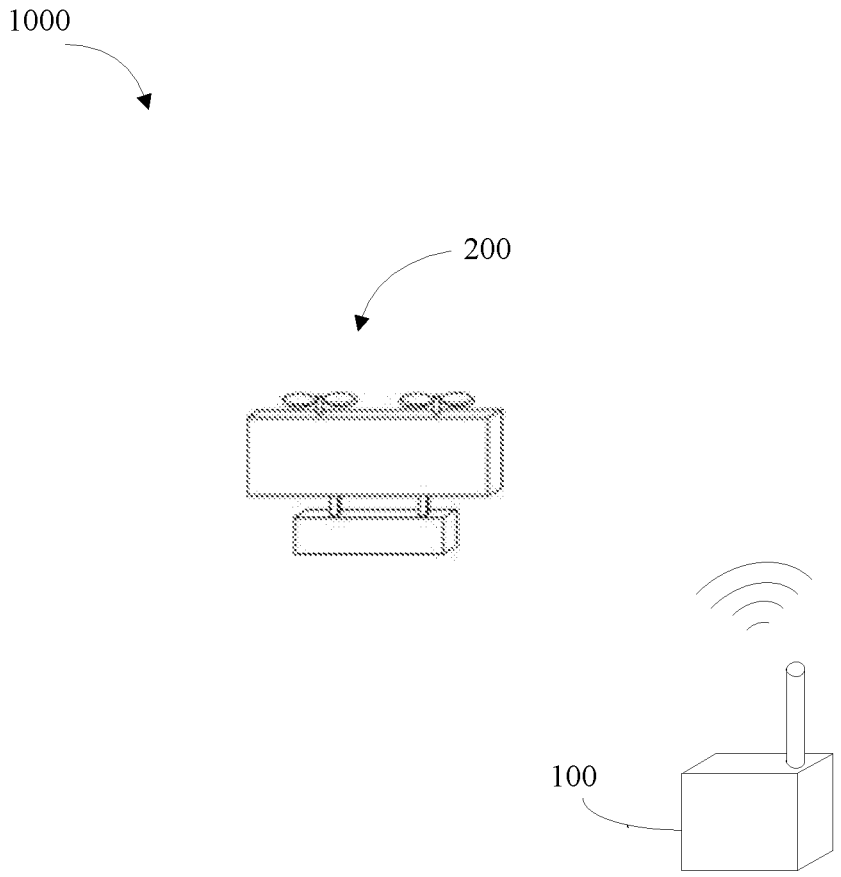
FIG. 8 schematically shows a plan view of an unmanned aerial vehicle (UAV) system consistent with the disclosure.

FIG. 8 schematically shows a plan view of an example UAV system 1000 consistent with the disclosure. As shown in FIG. 8, the UAV system 1000 includes a UAV 200 and the remote-control apparatus 100 described above.

According to the UAV system 1000 consistent with the disclosure, the antenna assembly can be detachably and rotatably mounted to the remote-control body by the cooperation of the elastic member 12 and the knob 14. The assembly and disassembly of the remote-control apparatus 100 can be simple and convenient and the storage and transportation of the UAV system 1000 can be facilitated.

As used herein, the terms "certain embodiment," "an embodiment," "some embodiments," "an example embodiment," "an example," "certain example," "some examples," or the like, refer to that the specific features, structures, materials, or characteristics described in connection with the embodiments or examples are included in at least one embodiment or example of the disclosure. The illustrative representations of the above terms are not necessarily referring to the same embodiments or examples. Furthermore, the specific features, structures, materials, or characteristics described may be combined in a suitable manner in any one or more embodiments or examples.

The terms "first," "second," or the like in the specification, claims, and the drawings of the disclosure are merely illustrative, e.g. distinguishing similar elements, defining technical features, or the like, and are not intended to indicate or imply the importance of the corresponding elements or the number of the technical features. Thus, features defined as "first" and "second" may explicitly or implicitly include one or more of the features. As used herein, "multiple" means two or more, unless there are other clear and specific limitations.

It is intended that the embodiments disclosed herein be considered as example only and not to limit the scope of the disclosure. Changes, modifications, alterations, and variations of the above-described embodiments may be made by those skilled in the art within the scope of the disclosure. The scope of the invention can be defined by the following claims or equivalent thereof.

What is claimed is:

1. A connection structure comprising:

an elastic member including:

a bottom portion; and an elastic piece extending from the bottom portion and including a free end not contacting the bottom portion, the free end including:

a first protrusion extending outward along a radial direction of the elastic member; and a second protrusion extending inward along the radial direction of the elastic member; and a knob configured to engage with the elastic member and including a fitting slot formed at an inner wall of the knob, the fitting slot including a first portion and a second portion in a circumferential direction of the knob for engaging with the first protrusion of the elastic piece, and a depth of the first portion being smaller than a depth of the second portion.

2. The structure of claim 1, wherein:

the bottom portion includes:

a chassis;

a connection portion extending upward from an edge of the chassis; and an abutting portion extending inward along the radial direction of the elastic member from an end of the connection portion distal from the chassis; and the elastic piece extends upward and outward along the radial direction of the elastic member from an end of the abutting portion distal from the connection portion.

3. The structure of claim 1, wherein the first protrusion includes a portion of the free end that bends outward along the radial direction of the elastic member.

4. The structure of claim 3, wherein an end of the first protrusion includes a curved edge.

5. The structure of claim 4, wherein the second portion includes a circular arc shaped recess that matches the curved edge of the first protrusion.

6. The structure of claim 1, wherein the second protrusion includes a portion of the free end that bends inward along the radial direction of the elastic member.

7. The structure of claim 1, wherein the second protrusion includes a portion of the free end that has a convex shape and protrudes inward along the radial direction of the elastic member.

8. The structure of claim 1, wherein:

the knob includes an operation portion; and an outer edge of a cross section of the operation portion perpendicular to a central axis of the operation portion has a polygonal shape or a circle shape having a plurality of concave or convex sub-arcs.

9. An apparatus comprising:

a first component including a plug portion having a cylindrical shape and including a first fitting slot formed at an outer axial surface of the plug portion;

a second component including:

a housing; and a bushing extending outward from the housing, the plug portion being inserted in the bushing when the first component is mounted to the second component; and a connection structure configured to mount the first component to the second component, the connection structure including:

an elastic member configured to extend from an inside of the housing to an outside of the bushing and including:

a bottom portion configured to be locked at the housing; and an elastic piece extending from the bottom portion to the bushing and including a free end, the free end including:

a first protrusion extending outward along a radial direction of the elastic member; and a second protrusion extending inward along the radial direction of the elastic member; and a knob configured to be rotatably sleeved on the bushing and including a second fitting slot formed at an inner wall of the knob, the second fitting slot including a first portion and a second portion in a circumferential direction of the knob for engaging with the first protrusion of the elastic piece, and a depth of the first portion being smaller than a depth of the second portion, the second fitting slot is configured such that:

when the first protrusion engages with the first portion, the second protrusion is fitted in the first fitting slot to fixedly attach the first component to the second component; and when the first protrusion engages with the second portion, the second protrusion disengages from the first fitting slot to allow the first component to be detached from the second component.

10. The apparatus of claim 9, wherein:

the bottom portion includes:

a chassis;

a connection portion extending upward from an edge of the chassis; and an abutting portion extending inward along the radial direction of the elastic member from an end of the connection portion distal from the chassis, the abutting portion being configured to abut against a bottom surface of the housing to attach the elastic member to the second component; and the elastic piece extends upward and outward along the radial direction of the elastic member from an end of the abutting portion distal from the connection portion.

11. The apparatus of claim 10, wherein an inner surface of the bushing has an inverted truncated cone shape.

12. The apparatus of claim 9, wherein the first protrusion includes a portion of the free end that bends outward along the radial direction of the elastic member.

13. The apparatus of claim 12, wherein an end of the first protrusion includes a curved edge.

14. The apparatus of claim 13, wherein the second portion includes a circular arc shaped recess that matches the curved edge of the first protrusion.

15. The apparatus of claim 9, wherein the second protrusion includes a portion of the free end that bends inward along the radial direction of the elastic member.

16. The apparatus of claim 9, wherein the second protrusion includes a portion of the free end that has a convex shape and protrudes inward along the radial direction of the elastic member.

17. The apparatus of claim 9, wherein the first fitting slot includes an annular groove cooperating with the second protrusion.

18. The apparatus of claim 9, wherein:

the knob includes an operation portion; and an outer edge of a cross section of the operation portion perpendicular to a central axis of the operation portion has a polygonal shape or a circle shape having a plurality of concave or convex sub-arcs.

* * * * *